United States Patent [19]

Gillotti

[11] Patent Number: 4,971,040

[45] Date of Patent: Nov. 20, 1990

[54] PORTABLE MASSAGE CHAIR

[76] Inventor: Michael A. Gillotti, P.O. Box 208, Catati, Calif. 94928

[21] Appl. No.: 376,878

[22] Filed: Jul. 6, 1989

[51] Int. Cl.[5] ..... A61H 1/00

[52] U.S. Cl. ..... 128/24 R; 128/72; 269/328

[58] Field of Search ..... 128/24 R, 33, 70–75, 128/68, 78; 269/323–325, 328

[56] References Cited

U.S. PATENT DOCUMENTS

| | | | |
|---|---|---|---|
| D. 269,543 | 6/1983 | Walper et al. | 128/71 |
| 1,527,754 | 2/1925 | Simon | 5/443 |
| 1,830,071 | 11/1931 | Patton | 128/72 |
| 2,976,868 | 3/1961 | Weissenberg | 128/71 |
| 3,210,779 | 10/1965 | Herbold | 128/74 |
| 3,227,439 | 1/1966 | Carlson | 128/72 |
| 3,227,440 | 1/1966 | Scott | 128/72 |
| 3,815,586 | 6/1974 | Kazik | 128/70 |
| 4,207,879 | 6/1980 | Sajadago et al. | 128/70 |
| 4,354,485 | 10/1982 | Sajadago | 128/70 |
| 4,662,361 | 5/1987 | Patterson | 128/70 |

OTHER PUBLICATIONS

Braces Today, the Conquest of the Crooked Back, Oct. 1957.

*Primary Examiner*—Edgar S. Burr
*Assistant Examiner*—Huong Q. Pham
*Attorney, Agent, or Firm*—Larry D. Johnson

[57] ABSTRACT

A portable massage chair provides an integral, collapsible chair apparatus enabling on-site massage therapy. The chair comprises a generally elongate upright body member having a pair of side panels and carrying a chest cushion and face cushion, with a pair of arm cushions outwardly extendable from the side panels. A leg portion is pivotally connected to the body member. A seat cushion and seat support member are pivotally connected to the leg portion, and extend forward through the body member side panels to present the seat cushion beneath the chest cushion. The seat support member includes a receiver element beneath the seat cushion engageable with a complementary post element carried between the body member side panels. Thus, the leg portion, seat cushion, and seat support member are all movable to be carried within the side panels for storage and transport.

5 Claims, 2 Drawing Sheets

PORTABLE MASSAGE CHAIR

BACKGROUND OF THE INVENTION

1. Field of the Invention

This invention relates generally to chairs and related furniture, and more specifically to an improved collapsible chair suitable for supporting an individual receiving a massage.

2. Description of the Prior Art

Massage therapy has become increasingly popular in recent years. Unfortunately, many individuals are reluctant or unable to travel to a traditional massage studio, and thus are denied the benefits of receiving a massage. Accordingly, several designs of portable massage tables and chairs have been proposed, to enable the practitioner to provide massage treatment on-site at homes, offices, shopping malls, and the like. However, most known portable massage chairs are heavy and awkward to transport, and require time-consuming setup at the massage site before they can be used.

SUMMARY OF THE INVENTION

The portable massage chair of this invention provides an integral, easily collapsible chair apparatus enabling on-site massage therapy. The massage chair comprises a generally elongate upright body member having a pair of side panels and carrying a chest cushion and face cushion, with a pair of arm cushions outwardly extendable from the side panels. A leg portion is pivotally connected to the body member proximate the chest cushion and arm cushions, enabling the leg portion to be folded into the body member for transport, and extended from the body member to provide a stable platform for the massage chair when in use. A seat cushion and seat support member are pivotally connected to the leg portion, and extend forward through the body member side panels to present the seat cushion beneath the chest cushion. The seat support member includes a receiver element beneath the seat cushion engageable with a complementary post element carried between the body member side panels, with that section of the seat support member located between the seat cushion and the leg portion being configured to avoid contact with the post element when the leg portion is collapsed within the body member. Thus, the leg portion, seat cushion, and seat support member are all movable to be carried within the body member side panels for storage and transport.

DETAILED DESCRIPTION OF A PREFERRED EMBODIMENT

Figure 1:
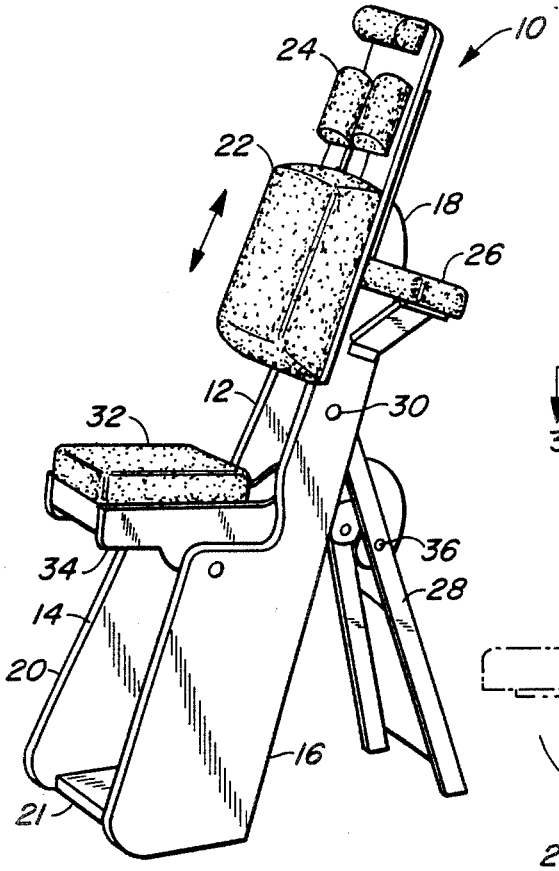
FIG. 1 is a perspective view of the portable massage chair of this invention in its operating (erected) position, illustrating the relative arrangement of the massage chair body member, seat cushion and seat support member, and leg portion.

FIG. 1 is a perspective view of the portable massage chair 10 of this invention in its operating (erected) position. Massage chair 10 comprises a generally elongate upright body member 12 having a pair of side panels 14, 16 together forming an upper portion 18 and lower portion 20, this lower portion terminating in a base 21. Upper portion 18 carries chest cushion 22 and face cushion 24, each of which may be vertically adjustable along the body member upper portion to accommodate different body sizes of the individuals being treated. A pair of arm cushions 26 are outwardly extendable from the side panels 14, 16, as described infra. A leg portion 28 is pivotally connected to body member 12 at body/-leg pivot 30, proximate chest cushion 22. A seat cushion 32 and seat support member 34 are pivotally connected to leg portion 28 at seat support/leg pivot 36. Seat support member 34 extends forward through the side panels 14, 16 to present seat cushion 32 beneath chest cushion 22. Thus, in this erected configuration, massage chair 10 provides a stable platform upon which an individual can sit and relax against while receiving a massage.

Figure 2:
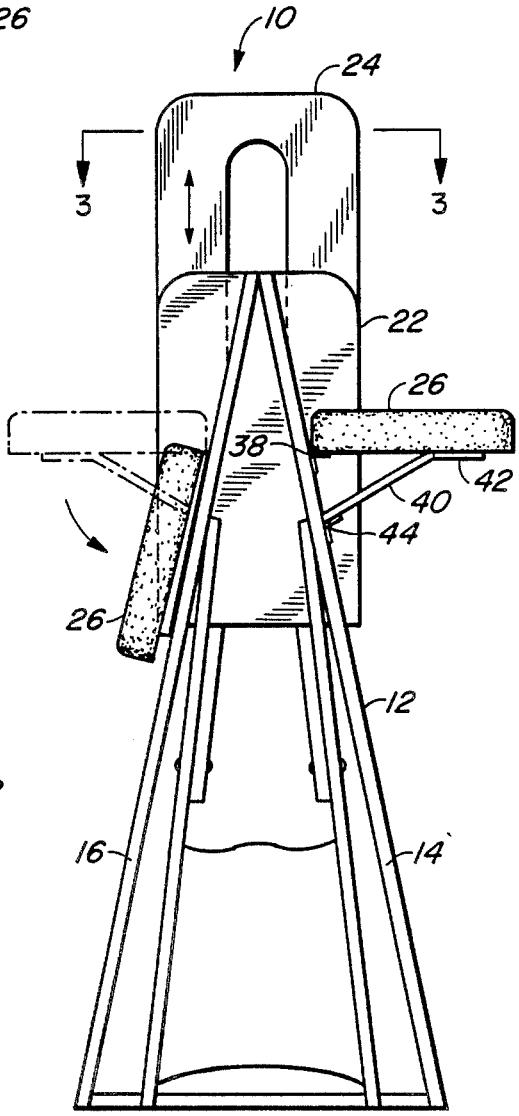
FIG. 2 is a rear elevation view of the portable massage chair of this invention in its operating (erected) position, illustrating the extension of the arm cushions to their operating position.

FIG. 2 is a rear elevation view of the portable massage chair 10 of this invention in its operating (erected) position, illustrating the extension of the arm cushions 26 to their operating position. Arm cushions 26 are elevated from their folded position against side panels 14, 16 to their extended position generally perpendicular to the side panels (and parallel to the floor) by movement about hinge 38. Once extended, the arm cushions are held in this position by placement of brace 40 against block 42 beneath the arm cushion 26, thereby fixing the arm cushion in the extended position and permitting the individual to lean against and apply weight upon the cushions. Brace 40 may itself be collapsible against the side panels by means of hinge 44.

Figure 3:
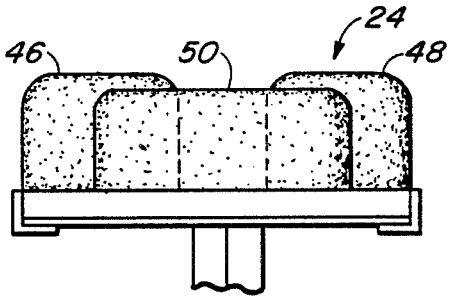
FIG. 3 is a top plan view of the face cushion portion of the portable massage chair of this invention, this view taken along line 3—3 of FIG. 2.

FIG. 3 is a top plan view of the face cushion portion 24 of the portable massage chair of this invention, this view taken along line 3—3 of FIG. 2. Face cushion 24 preferably includes a pair of side cushions 46, 48, and a forehead cushion 50. This arrangement allows the individual to fully lean into these cushions and yet comfortably breathe while the massage is being administered.

Figure 4:
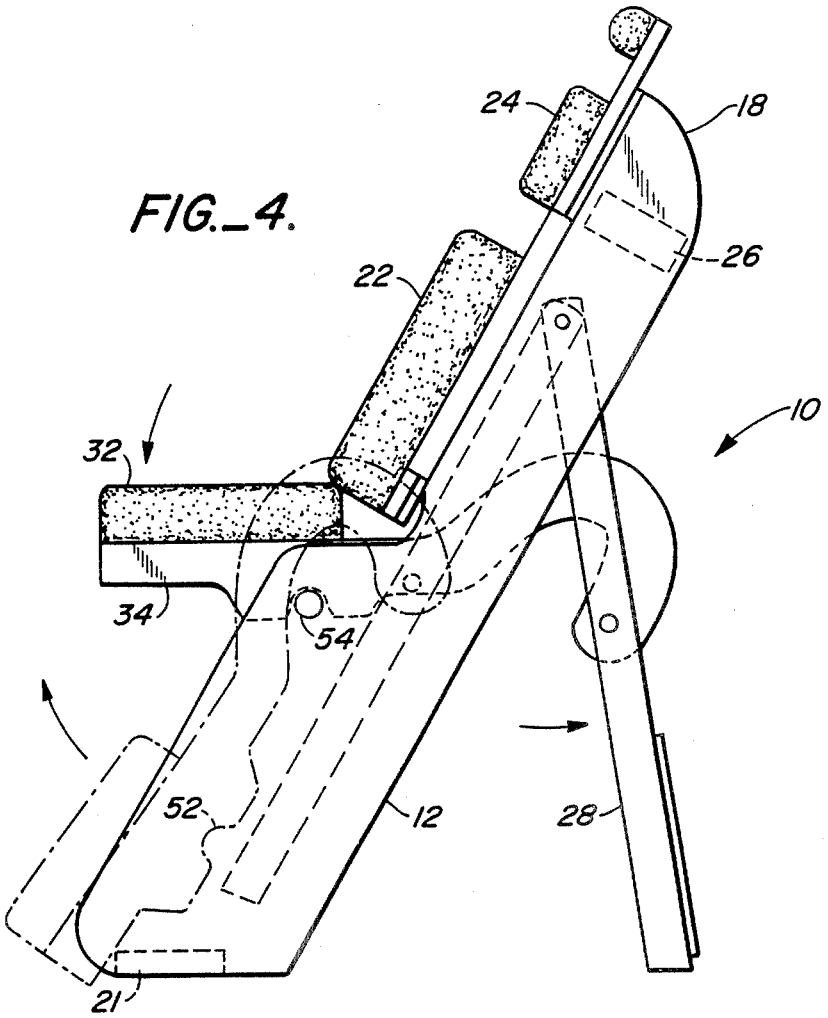
FIG. 4 is a side elevation view of the portable massage chair of this invention illustrating the erection technique of the chair from its folded position (seat and leg portions shown in phantom lines) to its operating position (seat and leg portions shown in solid lines)

FIG. 4 is a side elevation view of the portable massage chair of this invention illustrating the erection technique of the chair from its folded position (seat and leg portions shown in phantom lines) to its operating position (seat and leg portions shown in solid lines).

To erect the portable massage chair, the body member base portion 21 is placed on the floor, and the adjustable chest cushion 22 and face cushion 24 are raised up along the body member upper portion 18 from their storage position. Next, the seat cushion 32 is lifted up and the leg portion 28 is pushed rearward until seat support member 34 notch or receiver element 52 is aligned with body member dowel or post element 54, and the seat cushion is then dropped down to engage the receiver element into the post element. The arm cushions 26 are then raised to their operating position, as described supra. Finally, the chest cushion 22 and face cushion 24 are adjusted for maximum comfort to the individual receiving the massage.

To use the massage chair, the individual receiving the massage sits on the seat cushion 32 and leans forward into the chest cushion 22 and face cushion 24, resting his arms on the arm cushions 26. This position allows the individual to fully relax those muscles needed to maintain his posture, and thus achieve a deeper level of relaxation while being treated.

Figure 5:
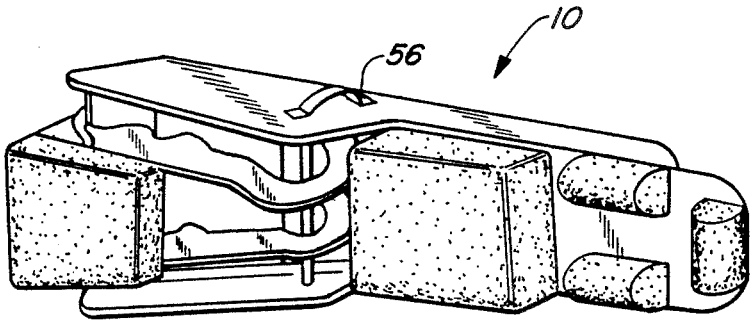
FIG. 5 is a perspective view of the portable massage chair of this invention in its folded position and lying on its side for carrying.

FIG. 5 is a perspective view of the portable massage chair 10 of this invention in its folded position and lying on its side for carrying. Carrying handle 56 may be attached to one of the side panels 14 near the center of gravity of the folded massage chair.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A portable massage chair having an erected configuration and a collapsed configuration, said portable massage chair comprising:

a generally elongate body member having a pair of side panels, and an upper portion and a lower portion, said lower portion terminating in a base forming a first ground support member for said portable massage chair;

a chest cushion attached to said body member upper portion;

a face cushion attached to said body member upper portion;

a pair of arm cushions attached to said body member upper portion;

a leg portion pivotally connected to said body member at a leg/body pivot, said leg portion extending from said body member forming a second ground support member for said portable massage chair when said portable massage chair is in said erected configuration, and said leg portion retracting within said body member side panels when said portable massage chair is in said collapsed configuration; and a seat support member bearing a seat cushion, said seat support member pivotally connected to said leg portion at a seat/leg pivot, said seat support member extending through said side panels to present said seat cushion beneath said chest cushion when said portable massage chair is in said erected configuration, and said seat support member retracting within said body member side panels when said portable massage chair is in said collapsed configuration.

2. The portable massage chair of claim 1 wherein said seat support member includes a receiver element, and said body member includes a complementary post element extending between said body member side panels and engaging said seat support member receiver element when said portable massage chair is in said erected configuration, and not contacting said seat support member when said portable massage chair is in said collapsed configuration.

3. The portable massage chair of claim 1 wherein said chest cushion includes adjustment means for moving said chest cushion vertically along said body member upper portion.

4. The portable massage chair of claim 1 wherein said face cushion includes adjust means for moving said face cushion verically along said body member upper portion.

5. The portable massage chair of claim 1 wherein said arm cushions include hinge means enabling folding against said body member upper portion and extension perpendicular to said body member upper portion.

* * * * *